United States Patent [19]

de Jager

[11] 4,411,079

[45] Oct. 25, 1983

[54] SUCTION DRAG SYSTEM

[75] Inventor: Arie de Jager, Sliedrecht, Netherlands

[73] Assignee: IHC Holland N.V., Pependrecht, Netherlands

[21] Appl. No.: 320,291

[22] Filed: Nov. 10, 1981

[30] Foreign Application Priority Data

Nov. 13, 1980 [NL] Netherlands ..... 8006209

[51] Int. Cl.[3] ..... E02F 3/88

[52] U.S. Cl. ..... 37/58; 37/72

[58] Field of Search ..... 37/72, 58; 114/29

[56] References Cited

U.S. PATENT DOCUMENTS

| | | | |
|---|---|---|---|
| 1,619,850 | 3/1927 | Casey | 37/67 |
| 2,731,741 | 1/1956 | Kaufman | 37/54 |
| 2,786,284 | 3/1957 | Todd | 37/81 |
| 3,198,156 | 8/1965 | Kunz | 114/29 |
| 4,282,661 | 8/1981 | Nagelkerke | 37/72 X |

FOREIGN PATENT DOCUMENTS

| | | | |
|---|---|---|---|
| 53804 | 1/1943 | Netherlands . | |
| 282766 | 8/1962 | Netherlands . | |
| 6501544 | 8/1966 | Netherlands . | |
| 113375 | 11/1966 | Netherlands . | |
| 6708587 | 12/1967 | Netherlands . | |
| 7006095 | 12/1970 | Netherlands . | |
| 7300880 | 7/1973 | Netherlands . | |
| 1377 | of 1913 | United Kingdom . | |
| 657181 | 9/1951 | United Kingdom | 37/72 |
| 694954 | 7/1953 | United Kingdom | 37/72 |
| 750669 | 6/1956 | United Kingdom | 37/72 |
| 969727 | 9/1964 | United Kingdom | 37/72 |

*Primary Examiner*—Clifford D. Crowder

*Attorney, Agent, or Firm*—Young & Thompson

[57] ABSTRACT

The invention relates to a suction drag system for dredging vessels which can be placed or removed respectively on an existing vessel, such as a hopper barge (1,2), the system comprising a suction pipe (26,28) with suction head, a suction pump (29) with drive motor (30), an elbow section (25) on deck and derricks (41) to handle the suction pipe (26,28). These components are separate units to be installed on deck and are units each having a frame (8,9,10) which can be installed disconnectably transversely over the hold (4) onto the coamings (5,6) of the vessel, a further frame (7) being possible carrying the drive unit for the dredging system, these frames (7,8,9,10) in case of a split hopper barge (1,2) being pivotably connected (11) to one coaming (6) and pivotably as well as movably in transverse direction (12,13) to the other coaming (5).

7 Claims, 7 Drawing Figures

SUCTION DRAG SYSTEM

Suction drag system for a dredging vessel, comprising a suction pipe with suction head and a distant suction pump with drive motor, whereby the upper part of the suction pipe behind the pump is pivotably connected to an elbow section, positioned on deck of the ship and giving access to a discharge pipe or chute, which suction pipe near the suction head and/or at a location between said suction head and the elbow section is suspended from derricks or davits by means of which the pipe can be brought outboard and lowered respectively raised and brought inboard, whereby said derricks, the suction pipe, the elbow section and the discharge pipe are components, which can be installed on deck of the ship as separate units.

Such a suction drag system is described in NIVAG CONTOUR, May 1979, pages 22–24, and also in the thereto related Dutch Patent Application 7810861, which is laid open to public inspection.

With such a suction drag system and using a standard model self-propelled hopper vessel, i.e. a hopper vessel with its own propelling means, it is in a very simple way possible to realize a suction drag dredging system by mounting a number of separate, on deck installable units, such as the elbow section, the suction pipe to be coupled with said elbow section, the discharge pipe or chute and one or more derricks or davits. The result thereof is that no means for guiding and connecting the suction pipe have to be installed in the side wall of the ship's hull and that repair and maintenance of the various components of the dredging system can take place without the necessity to dock the ship. The above-mentioned units are thereby positioned at one side of the vessel which has in general the consequence that ballast should be added at the other side, which decreases the carrying capacity. The power for driving the dredging pump can be derived from the propelling engines of the vessel by dimensioning said engines such, that they are also able to deliver hydraulic or electric power to the suction pump. In general it is therefore not possible to use an existing propelling engine, because such an engine is exclusively designed for delivering propelling power.

An object of the invention is to provide a suction drag system which is also combined from units, which can be mounted on deck, which units, however, can be disconnectably installed on each type of vessel comprising a hold for receiving dredged material, such as for instance vessels of the type discharging through the bottom, and is especially suited for split hopper vessels.

According to the invention this object is realized in that all units, functioning for supporting and handling the suction pipe comprise a supporting frame, which can be installed disconnectably transversely over the hold or holds on the coamings of the ship.

In this way the whole suction drag system can be built from preferably standardized and relatively compact elements, whereby it is very simple to exchange units or (in case of a standard ship) to mount them on another vessel. Furthermore an improved weight distribution is obtained and the free space above the hold is profitably used for optionally installing the respective units. The supporting frame can be embodied very easily such that the present width, measured from coaming to coaming, is taken into account and optionally the supporting frame can be adjustable, so that it can be used with various ship widths. Viewed in the length direction of the vessel the units can be installed at each desirable place, and this means the unit carrying the elbow section can be positioned, viewed in the length direction of the vessel, at each desired point and the thereto connected discharge pipes can extend either forwards or backwards. The elbow section of the above mentioned known installation is installed on the forecastle before the holds, whereas the discharge pipe is supported by permonent supporting brackets, positioned in the hold and therefore creating an obstruction. By using the supporting frames it is furthermore possible to position the derricks further inwards, so that, when the suction pipe is brought inboard the weight distribution is enhanced, and furthermore it is possible to install the winches and corresponding drive motors on the end of the supporting frames opposite the suction pipe.

An especially preferred embodiment is obtained in case besides the units for supporting and handling the suction pipe furthermore a drive unit is positioned on a supporting frame extending transversely over the hold and connected to the coamings. The whole drag system has his own energy source, so that the system can be installed on each type of vessel without the necessity to increase the power of the propelling engines thereof. Said power unit preferably consists of a motor with generator and/or a pump, means for supplying energy to the suction pump motor and means for supplying energy to the winches of the derrick units.

With the prior art split hopper dredges as described in the above-mentioned article in NIVAG CONTOUR one encounters in a more intensified degree the objection that the units are installed only at one side of the ship. According to the invention the supporting frames of the units can be advantageously used together with split hopper vessels when said supporting frames at one end are pivotably connected to the nearby coaming and at their other end pivotably and in transverse direction movably connected to the other coaming. The movable connection makes possible to open and close the split hopper vessel, thereby maintaining the horizontal position of the supporting frames.

The drive unit preferably comprises operating and controlling means for the dredging device and said means are preferably installed in or on the unit, i.e. in a cabin positioned onto said supporting frame.

The elbow section of the suction drag system decribed in the Dutch Patent Application 7810861 is supported in guiding elements installed onto the deck of the vessel and movable transverse to the longitudinal axis of said vessel by means of a hydraulic cylinder. Said transverse movement is necessary when the suction pipe is brought outboard respectively brought inboard. For this purpose, the elbow section has an elbow, which during the outboard movement realizes the connection with the discharge pipe which is installed at a fixed position above the hold. That means that said connection is not permanent. According to a preferred embodiment of the invention said elbow section is permanently connected to the discharge pipe or chute and comprises a pivot joint with a horizontal axis between the adjacent elbow section and the turn piece connected to the suction pipe, whereby said turn piece is pivotably connected to arms, mounted onto the support frame, which arms together with the pivot joint in the pipe section and with the pivotable connection between the elbow and the supporting frame form a parallelogram guide actuated by said cylinder. In this embodiment the pivot joint in the pipe section is preferably realized by means of two yokes, connected to each other and pivotable around a horizontal axis, whereby a hose-piece is extending through said yokes. Because of said hose-piece and because of the parallelogram guiding a permanent connection is possible.

It is furthermore possible to embody each derrick unit such, that the winch and winch motor are positioned at one end of the support frame opposite the slewing jib of the derrick and at the position of the outboard slewing jib the cable of said winch is guided by a cable pulley supported by bearings at a distance above the pivot shaft of said slewing jib and by a cable pulley at or ner the end of said jib, which jib furthermore comprises means for blocking the jib in the elevated position and in the outboard reaching position and arresting means at the underside or outer side of the suction pipe. Not only a favourable weight distribution is obtained thereby, but also during the raising procedure of the suction pipe the jib of the derrick will sway upwards from the horizontal position as soon as the suction pipe is arrested against said jib. In the upwards directed position the jib can be locked in place whereafter the suction pipe can be lowered onto one or more saddles as is known from the state of the art. The result thereof is that separate hydraulic operating means of the derrick jib are superfluous.

According to the invention it is possible to use the supporting frames of the respective units, extending over the hold, for connecting the discharge tube or chute thereto.

More than with the proposal described in NIVAG CONTOUR the construction according to the invention leaves the original construction of the vessel unaltered, even to such a degree, that after removing the supporting frames the original condition of the vessel is completely restored.

The invention will now be explained in more detail with reference to the attached drawings.

The vessel illustrated in the above-mentioned Figures is of the type comprising two halves 1 and 2, which are able to carry out a mutually pivotal movement around a longitudinal axis 3.

The hold 4 has coamings 5 and 6.

Figure 1:
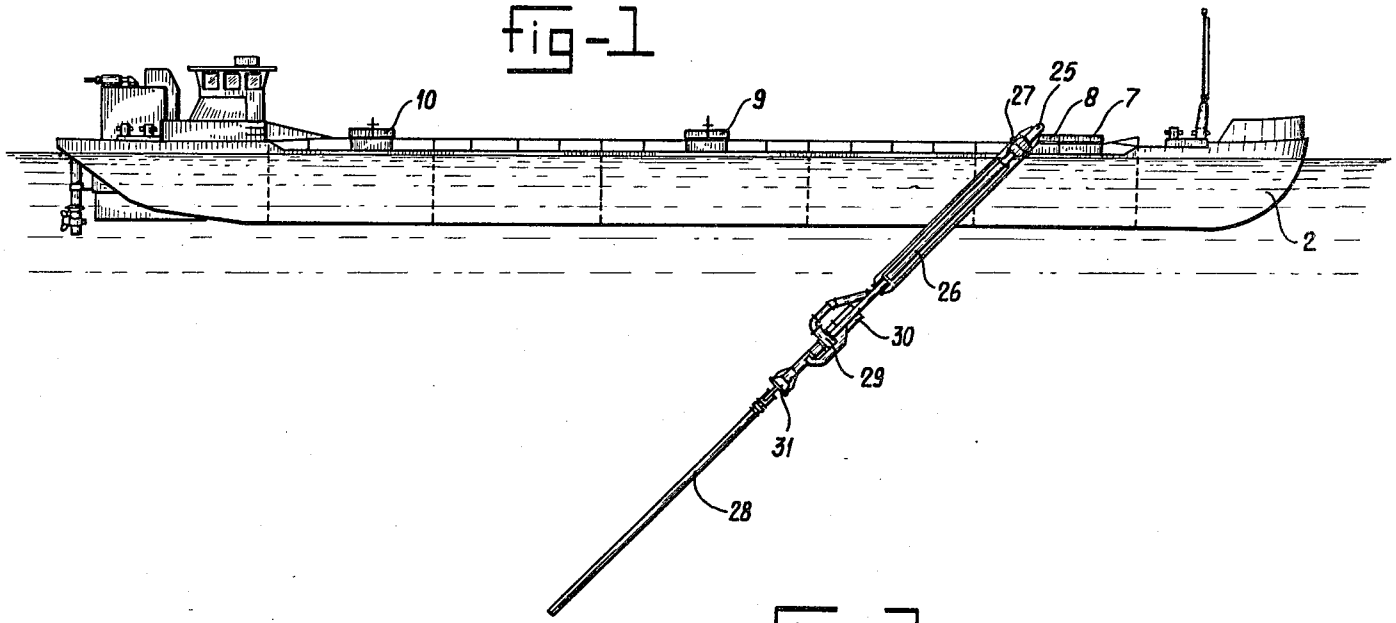
FIG. 1 illustrates a side-view of a vessel with a suction drag system according to the invention.
Figure 2:
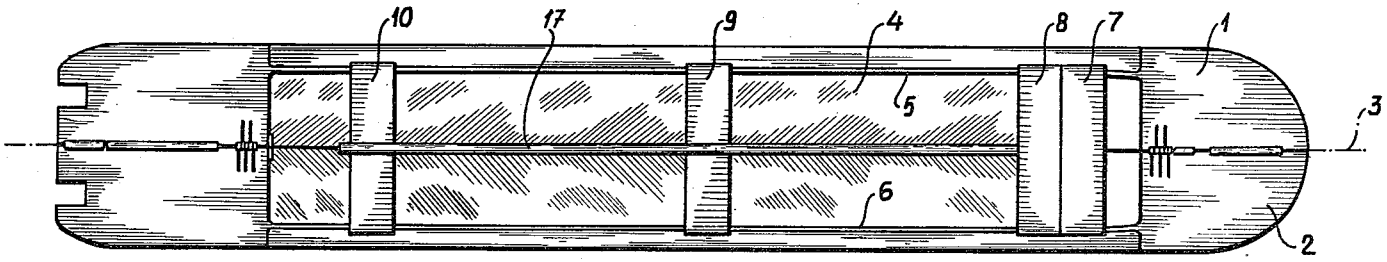
FIG. 2 illustrates a top-view of the ship according to FIG. 1.
Figure 3:
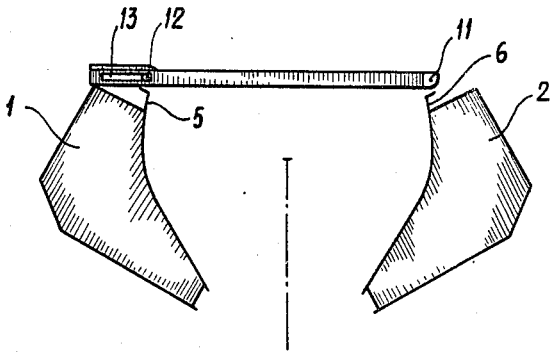
FIG. 3 illustrates schematically the application of the invention to a split hopper vessel.

A number of supporting frames is positioned transversely over said hold and connected to said coamings, such as the supporting frame for the drive unit 7, the supporting frame 8 for the elbow section, the supporting frame 9 for the derrick carrying the intermediate suction pipe and the supporting frame 10 for the derrick carrying the drag-head section of said pipe. Each supporting frame is, as is illustrated in FIG. 3, at one end connected to the coaming, for instance the coaming 6, by means of a pivot joint 11 and at their other end connected to for instance the coaming 5 by means of a number of roller elements running in a rectangular guiding element 13, such that the supporting frame and the related coaming are able to pivot and move in relation to each other. That is necessary, in order to allow the split movements of the vessel, whereby the supporting frames are maintained in their horizontal position. The supporting frame 8, which is in more detail illustrated in the FIGS. 4 and 5 and which carries the elbow section, comprises an elbow 14 supported by the frame 8 by means of a horizontal pivot 15 and by means of a rotatable coupling 16 realizing the connection with the discharge pipe 17 extending over the hold.

The end 18 of said elbow 14 opposite the discharge pipe 17 is fixedly connected to a yoke 19, which has at 20 a horizontal pivot joint with a yoke 21 fixedly connected to a pipe section 22 giving access to a turn-piece 23.

By means of an elbow 25 the suction pipe 26 is connected to said turn-piece, such that the upper part of said suction pipe 26 is coupled through a pivot joint 27 to said elbow 25.

Furthermore said suction pipe carries between the upper part 26 and the lower part 28 a suction pump 29 with drive motor 30, to which pump 29 the lower part 28 is connected through a universal joint 31.

Figure 6:
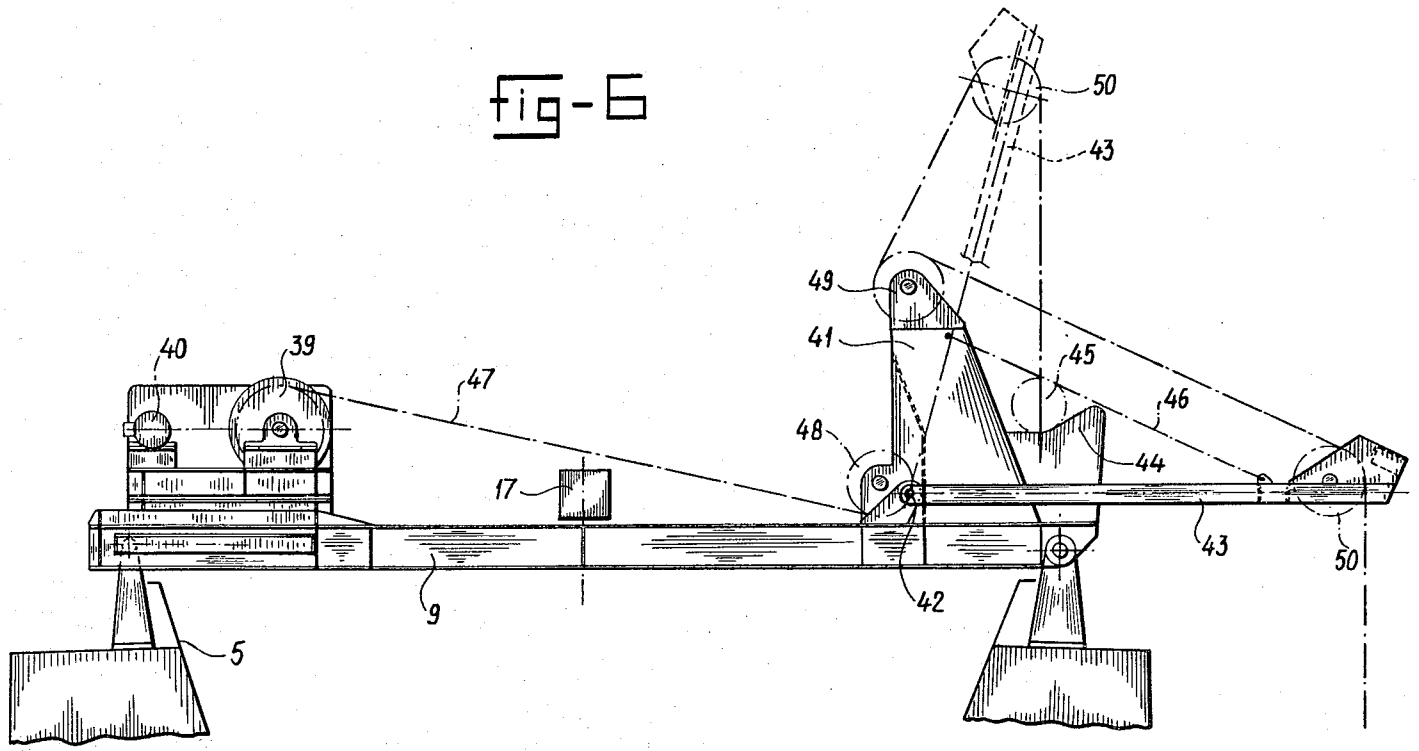
FIG. 6 illustrates a side-view of a derrick unit for the suction pipe.
Figure 7:
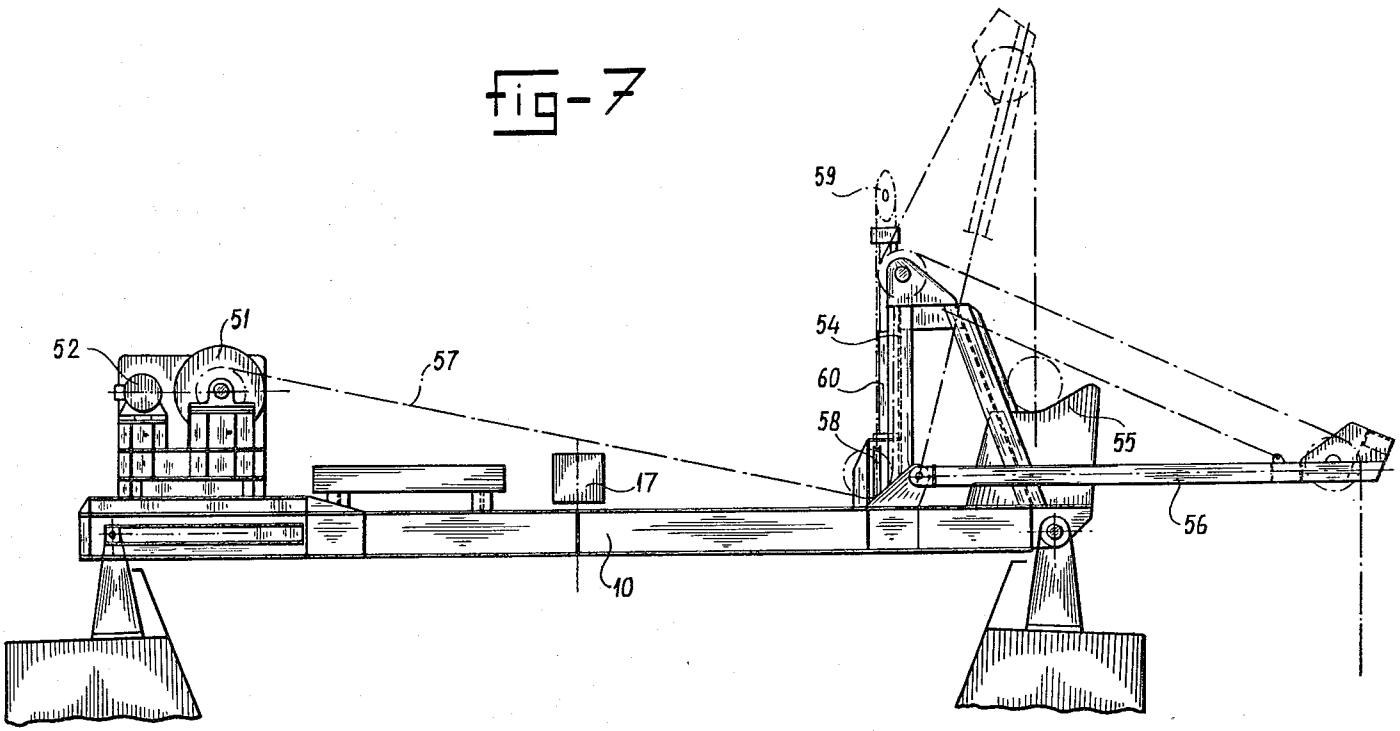
FIG. 7 illustrates a side-view of a derrick unit carrying the drag-head part of the suction pipe.

The suction pipe is carried at the motor-pump unit level by means of cables from the derrick positioned on the supporting frame 9 nd illustrated in FIG. 6, whereas the lower end carrying the not illustrated drag-head is by means of cables suspended from a derrick positioned on the supporting frame 10 and illustrated in FIG. 7.

Figure 5:
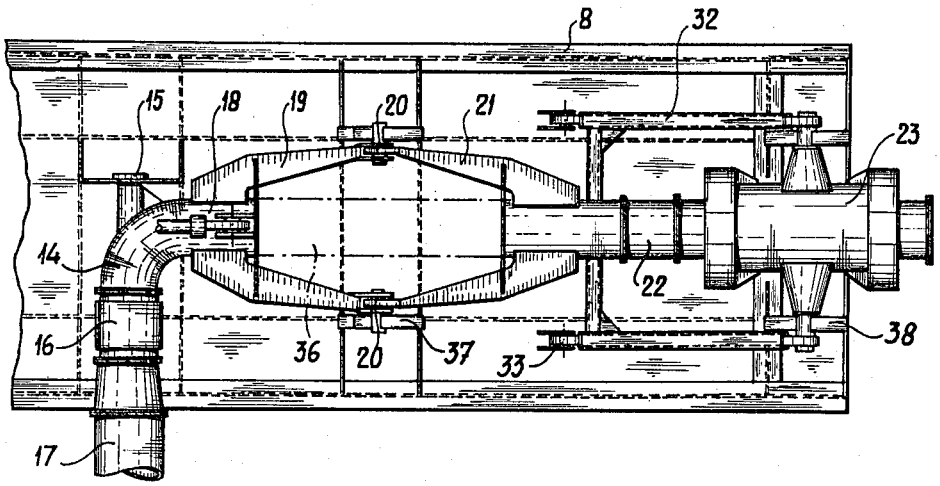
FIG. 5 illustrates a sectional view according to the line V—V in FIG. 4.
Figure 4:
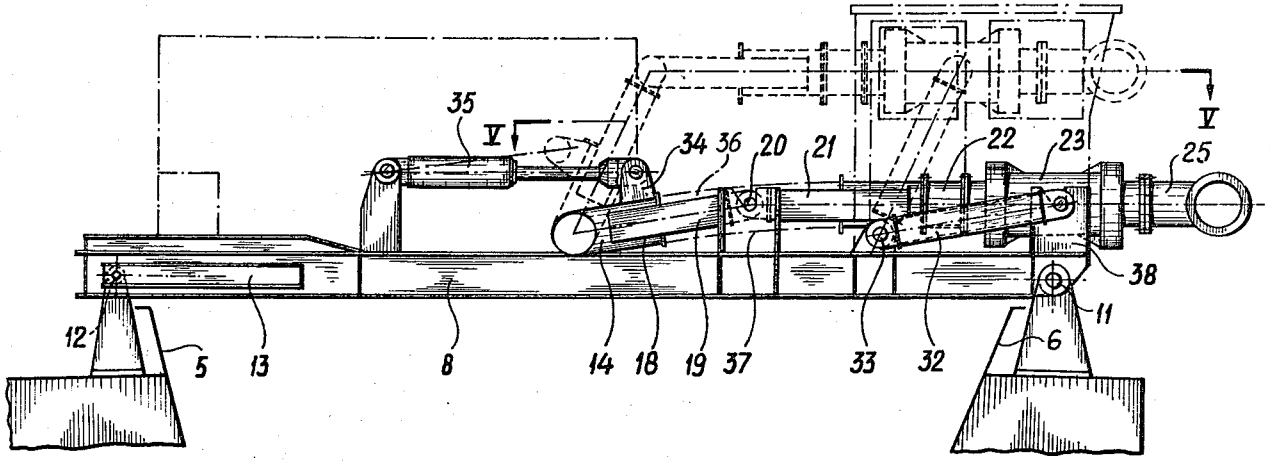
FIG. 4 illustrates a side-view of the elbow section unit.

The FIGS. 4 and 5 show that the turn-piece 23 is by means of the arms 32 pivotably connected to the supporting frame 8 at 33.

An eye-bracket 34 realizes the coupling between the elbow 14 and the hydraulic cylinder 35.

The distance between the pivot axis of the pivot 15 and the pivot axis 20 of the yokes 19 and 21 equals the length of the arms 32 between the pivot axes thereof.

A flexible hose 36 is installed between the bent section 14 and the pipe section 22.

By means of the cylinder 35 it is possible to swing the whole construction upwards from the resting position in the supporting elements 37, 38 to the position, illustrated with dash-and-dot lines, whereby the elbow 25 together with the yoke 19 and the arms 32 move parallel to their original position. In this way it is possible to bring the suction pipe connected to the turn-piece 23 inboard respectively outboard, without the necessity to interrupt the connection with the discharge pipe 17.

FIG. 6 illustrates the supporting frame 9 with a winch 39 and a drive motor 40 above the movable and pivotable connection with the coaming 5 and at the opposite side a derrick 41 with a jib 43 pivoting around a horizontal shaft 42. Said derrick includes a saddle 44 in which the suction pipe can rest as is indicated by the dash-and-dot line 45. Jib 43 is kept in the horizontal position by means of a flexible towing connection 46.

The cable of the winch 39 is indicated by 47 and runs over the lower pulley 48 of the derrick, an upper pulley 49 of the derrick 41 and a pulley 50 at the end of the jib 43.

FIG. 6 illustrates the situation with lowered pipe. When the cable 47 of the winch 39 is pulled in, then the suction pipe will be arrested by the jib 43 whereafter further pulling in of the winch cable 47 will result into an upwards swinging movement of the jib 43 to the position indicated by dash-and-dot lines, in which the suction pipe is brought inboard. Thereafter the suction pipe can be lowered onto the saddle 44.

FIG. 7 illustrates the frame 10 with winch 51 and drive motor 52 at one side and the derrick 54 at the other side, which derrick includes a saddle 55 and a jib 56. The winch cable 57 runs in the same way as the cable 47 in FIG. 6, the difference, however, is that in this case the winch cable also runs about the pulleys 58, 59 of the swell compensator 60 for the drag-head section which swell compensator itself is a known device.

The supporting frames 7 to 10 can be of a simple construction. They can be embodied with a fixed length adapted to the width dimension between the coamings of the vessel for which they are destined. However, it is also possible to embody them with an adjustable length, for instance by using mutually telescoping longitudinal guiders.

If the system has to be used on a vessel of the bottom discharging type, which means having doors in the bottom, then the movable pivotable construction 12, 13 is not necessary and a fixed connection to both coamings can be used.

The discharge pipe 17 can extend over the supporting frames 9 and 10.

Preferably the drive unit on the frame 7 consists of an internal combustion engine driving a generator and a hydraulic pump and delivering in this way energy for the motor 30 of the pump 29 and for the motors 40 and 52 of the winches, and delivering furthermore pressure for the cylinder 35 and eventual other additional aggregates.

I claim:

1. In a dredging vessel having a hold and coamings extending lengthwise of the vessel on opposite upper sides of the hold, the vessel having a suction drag system comprising a suction pipe with a suction pump, a discharge conduit for discharging dredged material into the hold, elbow means interconnecting the suction pipe and the discharge conduit, and derrick means by which the suction pipe may be moved outboard and lowered, and raised and brought inboard; the improvement comprising a plurality of support frames extending transversely across the hold and detachably secured at each end to a said coaming, at least one of said support frames carrying said derrick means and another of said support frames carrying said elbow means, said elbow means comprising parallelogram linkage disposed in a vertical plane transverse to the length of the vessel for raising and swinging inwardly, and lowering and swinging outwardly, the upper end of the suction pipe, a turnpiece providing a horizontal swivel joint between the elbow means and the upper end of the suction pipe about a horizontal axis transverse to the length of the vessel, and a horizontal cylinder for swinging said parallelogram linkage.

2. Structure as claimed in claim 1, another of said frames supporting a drive unit for moving said suction pipe.

3. Structure as claimed in claim 1, said vessel being a split hopper vessel adapted to open in two halves about an axis extending lengthwise of the vessel, and means mounting each said frame pivotally to one said coaming and for pivotal and relative sliding movement longitudinally of said frame to the other said coaming.

4. Structure as claimed in claim 1, said at least one frame of said derrick means carrying a winch and winch motor, a vertical swingable slewing jib swingably mounted about a horizontal axis that extends lengthwise of the vessel, a cable extending from said winch, a cable pulley supported above said horizontal axis of said jib, a cable pulley adjacent the end of said jib, said cable being reeved about said pulleys, said cable supporting said suction pipe.

5. Structure as claimed in claim 1, said discharge conduit being connected to said supporting frame of said elbow means.

6. Structure as claimed in claim 1, said derrick means comprising two derricks, one connected by a cable to an intermediate portion of the suction pipe and the other connected by a cable to the lower end of the suction pipe, each said derrick being mounted on a separate said frame.

7. Structure as claimed in claim 1, at least some of said frames being spaced apart lengthwise of the vessel.

* * * * *